US009713744B2

(12) United States Patent
Suzuki

(10) Patent No.: US 9,713,744 B2
(45) Date of Patent: Jul. 25, 2017

(54) EXERCISE THERAPY DEVICE

(71) Applicant: Mitsubishi Electric Engineering Company, Limited, Tokyo (JP)

(72) Inventor: Hironori Suzuki, Tokyo (JP)

(73) Assignee: Mitsubishi Electric Engineering Company, Limited (JP)

( * ) Notice: Subject to any disclaimer, the term of this patent is extended or adjusted under 35 U.S.C. 154(b) by 0 days.

(21) Appl. No.: 14/473,373

(22) Filed: Aug. 29, 2014

(65) Prior Publication Data

US 2015/0258381 A1 Sep. 17, 2015

(30) Foreign Application Priority Data

Mar. 17, 2014 (JP) ..... 2014-053246

(51) Int. Cl.
*A63B 24/00* (2006.01)
*A63B 22/06* (2006.01)
(Continued)

(52) U.S. Cl.
CPC ..... *A63B 24/0087* (2013.01); *A63B 21/002* (2013.01); *A63B 21/0058* (2013.01); *A63B 22/0605* (2013.01); *A63B 2022/0038* (2013.01); *A63B 2024/0065* (2013.01); *A63B 2024/0093* (2013.01); *A63B 2071/0652* (2013.01); *A63B 2220/16* (2013.01); *A63B 2220/34* (2013.01)

(58) Field of Classification Search
CPC . A63B 21/0058; A63B 24/0087; A63B 24/00; A63B 22/0605; A63B 2024/0093; A63B 21/225; A63B 2220/30; A63B 2220/17; A63B 2220/51; A63B 2024/009; A63B 21/00181; A63B 21/002; A63B 2024/0065; A63B 2220/54; A63B 2220/833; A63B 2230/062; A63B 22/025; A63B 24/0075; A63B 2071/0644; A63B 21/00069; A63B 21/00178; A63B 21/4045; A63B 2208/0233; A63B 2220/16; A63B 2022/0652; A63B 22/0242
USPC ..... 482/1–6
See application file for complete search history.

(56) References Cited

U.S. PATENT DOCUMENTS

2001/0036883 A1* 11/2001 Suzuki ..... A63B 21/00178 482/8
2005/0015118 A1* 1/2005 Davis ..... A61H 1/02 607/49

(Continued)

FOREIGN PATENT DOCUMENTS

| | | |
|---|---|---|
| JP | 62046193 | 10/1987 |
| JP | 2001299957 | 10/2001 |
| WO | 2013018205 | 2/2013 |

*Primary Examiner* — Andrew S Lo
(74) *Attorney, Agent, or Firm* — Price Heneveld LLP

(57) ABSTRACT

Provided are a control apparatus and method for an exercise therapy device, including: an isokinetic load control part for holding and adjusting a target rotation speed value and a gain for a left pedal and a target rotation speed value and a gain for a right pedal independently, to thereby perform the isokinetic load control to control a load torque to be applied to the left pedal and a load torque to be applied to the right pedal independently; and a switch for determining which of the isokinetic load control for the left pedal and the isokinetic load control for the right pedal is to be used, to thereby switch a measured rotation speed value and a target torque value.

5 Claims, 10 Drawing Sheets

(51) Int. Cl.

| | |
|---|---|
| ***A63B 21/002*** | (2006.01) |
| ***A63B 21/005*** | (2006.01) |
| *A63B 22/00* | (2006.01) |
| *A63B 71/06* | (2006.01) |

(56) References Cited

U.S. PATENT DOCUMENTS

| | | | | |
|---|---|---|---|---|
| 2013/0210580 | A1* | 8/2013 | Watterson | G06F 19/3481 482/8 |
| 2015/0141200 | A1* | 5/2015 | Murray | A63B 21/154 482/5 |
| 2015/0174447 | A1* | 6/2015 | Chiang | A63B 22/0605 482/8 |

* cited by examiner

EXERCISE THERAPY DEVICE

BACKGROUND OF THE INVENTION

1. Field of the Invention

The present invention relates to an exercise therapy device such as an ergometer, and more particularly, to a control apparatus and method for an exercise therapy device capable of controlling an exercise load by using isokinetic load control and constant-watt load control in combination even when the strength of the exerciser's leg significantly differs between his/her left and right legs.

2. Description of the Related Art

Hitherto, training using an exercise therapy device such an ergometer has been carried out in an exercise therapy, which is aimed at an increase of a physical strength and rehabilitation.

As one exercise load control method for such exercise therapy device, there is known isokinetic load control capable of generating an exercise load equivalent to a muscle strength exerted by an exerciser even when the muscle strength that can be exerted by the exerciser, or the physical condition or level of fatigue of the exerciser changes with time (see, for example, Japanese Patent Application Laid-open No. 2005-192781). In such a device as an ergometer with which the exerciser carries out an exercise of operating pedals of the device, a load amount transmitted to the device differs depending on a rotational position of each pedal. In such a case, through use of the isokinetic load control, which involves smoothly adjusting the load in a process during which the rotational position of each pedal changes, the exerciser can smoothly operate the pedals.

In such isokinetic load control, when the leg strength with which the exerciser steps on the pedals differs between his/her left and right legs, the control is performed so that the load strength suited to each of the leg strengths is applied, and hence the load strength being applied differs between the left pedal and the right pedal. This control is advantageous in that even when the exercise ability of one of the left and right legs is low, an arbitrary exercise load suited to the exercise ability of each of the legs can be applied without applying an excessive load.

Meanwhile, as another exercise load control method for such exercise therapy device, constant-watt load control, in which the exercise load is controlled so that a peak value or average value of the generated load is constant, can be used (see, for example, Japanese Patent Application Laid-open No. 2001-299957).

However, the related arts have the following problem.

When the muscle strength arbitrarily exerted by the exerciser changes every time in the case where the strength of the exerciser's leg significantly differs between his/her left and right legs, the load torque applied to each pedal and the rotation speed of each pedal significantly differ between the left and right pedals. Accordingly, in particular, when the isokinetic load control and the constant-watt load control are used in combination, the load torques of the left and right pedals varies with the isokinetic load control, and hence as a result, the watt to be applied by the constant-watt load control to be described later becomes less constant, which is a problem of the related arts.

SUMMARY OF THE INVENTION

The present invention has been made in view of the above-mentioned problem, and has an object to provide a control apparatus and method for an exercise therapy device capable of controlling an exercise load by using isokinetic load control and constant-watt load control in combination even when the strength of the exerciser's leg significantly differs between his/her left and right legs.

According to one embodiment of the present invention, there is provided a control apparatus for an exercise therapy device, which is configured to use isokinetic load control and constant-watt load control in combination when an exerciser operates pedals to carry out training, the isokinetic load control controlling a load torque to be applied to each of the pedals so that the load torque becomes equal to a rotation torque applied to the each of the pedals by pedaling of the exerciser, the constant-watt load control controlling a target torque value to be applied to the each of the pedals so that one of an average watt, which is an average value of a power in one rotation of the pedaling of the exerciser, and a peak watt, which is a maximum value of the power, becomes constant among rotations of the pedaling. The control apparatus includes: an isokinetic load control part for holding and adjusting a target rotation speed value and a gain for the left pedal and a target rotation speed value and a gain for the right pedal independently, to thereby perform the constant-watt load control among the rotations of the pedaling while performing the isokinetic load control to control the load torque to be applied to the left pedal and the load torque to be applied to the right pedal independently; and a switch for determining, based on one of information on the rotation torque applied to the each of the pedals by the pedaling of the exerciser and information on a rotational position of the each of the pedals, which of the isokinetic load control for the left pedal and the isokinetic load control for the right pedal is to be used, to thereby switch a measured rotation speed value, which is a value input to the isokinetic load control, and the target torque value, which is a value output from the isokinetic load control.

Further, according to one embodiment of the present invention, there is provided a control method for an exercise therapy device, which is configured to use isokinetic load control and constant-watt load control in combination when an exerciser operates pedals to carry out training, the isokinetic load control controlling a load torque to be applied to each of the pedals so that the load torque becomes equal to a rotation torque applied to the each of the pedals by pedaling of the exerciser, the constant-watt load control controlling a target torque value to be applied to the each of the pedals so that one of an average watt, which is an average value of a power in one rotation of the pedaling of the exerciser, and a peak watt, which is a maximum value of the power, becomes constant among rotations of the pedaling. The control method includes: holding and adjusting a target rotation speed value and a gain for the left pedal and a target rotation speed value and a gain for the right pedal independently, to thereby perform the constant-watt load control among the rotations of the pedaling while performing the isokinetic load control to control the load torque to be applied to the left pedal and the load torque to be applied to the right pedal independently; and determining, based on one of information on the rotation torque applied to the each of the pedals by the pedaling of the exerciser and information on a rotational position of the each of the pedals, which of the isokinetic load control for the left pedal and the isokinetic load control for the right pedal is to be used, to thereby switch a measured rotation speed value, which is a value input to the isokinetic load control, and the target torque value, which is a value output from the isokinetic load control.

According to one embodiment of the present invention, the target rotation speed value and the gain for the left pedal and the target rotation speed value and the gain for the right pedal are adjusted independently to perform the isokinetic load control independently on the load torque to be applied to the left pedal and the load torque to be applied to the right pedal. In addition, which of the isokinetic load control for the left pedal and the isokinetic load control for the right pedal is to be used is determined and switched based on the information on the rotation torque applied to each pedal by the exerciser's pedaling or the information on the rotational position of each pedal. As a result, it is possible to provide the control apparatus and method for an exercise therapy device capable of controlling the exercise load by using the isokinetic load control and the constant-watt load control in combination even when the strength of the exerciser's leg significantly differs between his/her left and right legs.

DETAILED DESCRIPTION OF THE PREFERRED EMBODIMENTS

Figure 1:
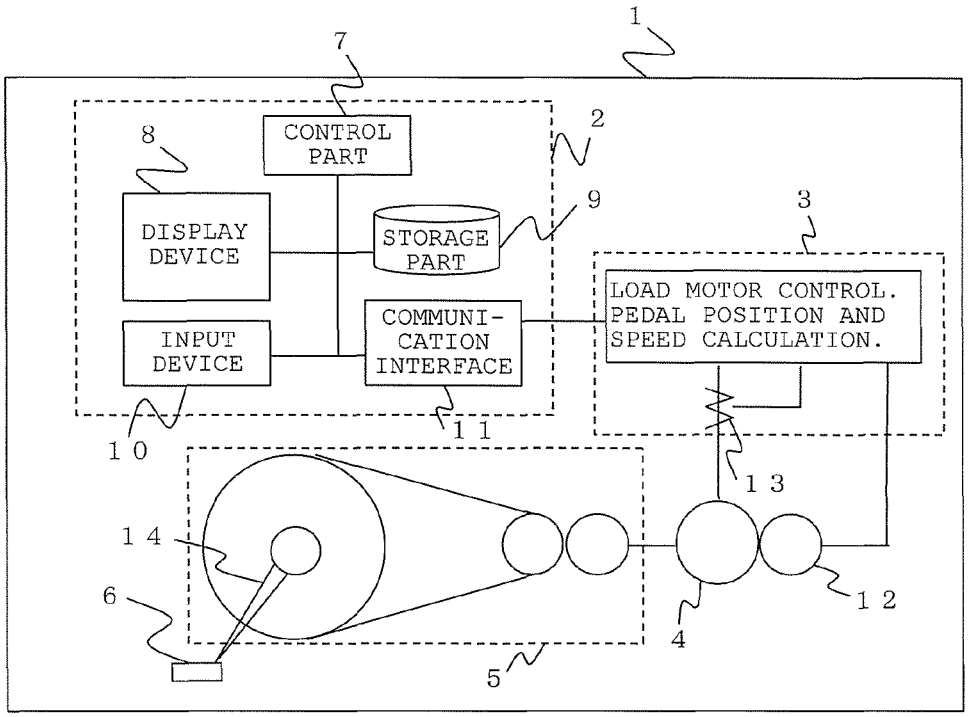
FIG. 1 is a diagram illustrating an example of a configuration of an exercise therapy device according to a first embodiment of the present invention.

A description is now given of a control apparatus and method for an exercise therapy device according to an exemplary embodiment of the present invention with reference to the accompanying drawings. Note that, throughout the drawings, like or corresponding components are denoted by like reference numerals to describe those components. Further, in the following, a description is first given of an overview of a related art with reference to FIGS. 8 to 10, and after that, a detailed description is given of a configuration and effects of the present invention with reference to FIGS. 1 to 7.

First Embodiment

In constant-watt load control, as expressed by Expression (1) given below, a load torque applied to each pedal is controlled so that a product of a target torque value for the pedal and a measured rotation speed value of the pedal is a constant target watt value. In other words, for example, when the measured rotation speed value for the pedal is changed, the target torque value is controlled so that the target watt value of Expression (1) given below becomes a constant value.

Meanwhile, in isokinetic load control, as expressed by Expression (2) given below, the target torque value for the pedal is calculated as a value obtained by multiplying a difference between the measured rotation speed value of the pedal and a target rotation speed value N of the isokinetic load control by a gain G.

Accordingly, when the isokinetic load control and the constant-watt load control are used in combination, the target rotation speed value N and the gain G of the isokinetic load control are adjusted so that a power applied to each pedal by each of the left and right legs becomes the constant target watt value.

$$W_{CMD}=T_{CMD}\times N_{FB}/9.55 \quad (1)$$

$$T_{CMD}=(N_{FB}-N)\times G \quad (2)$$

Figure 8:
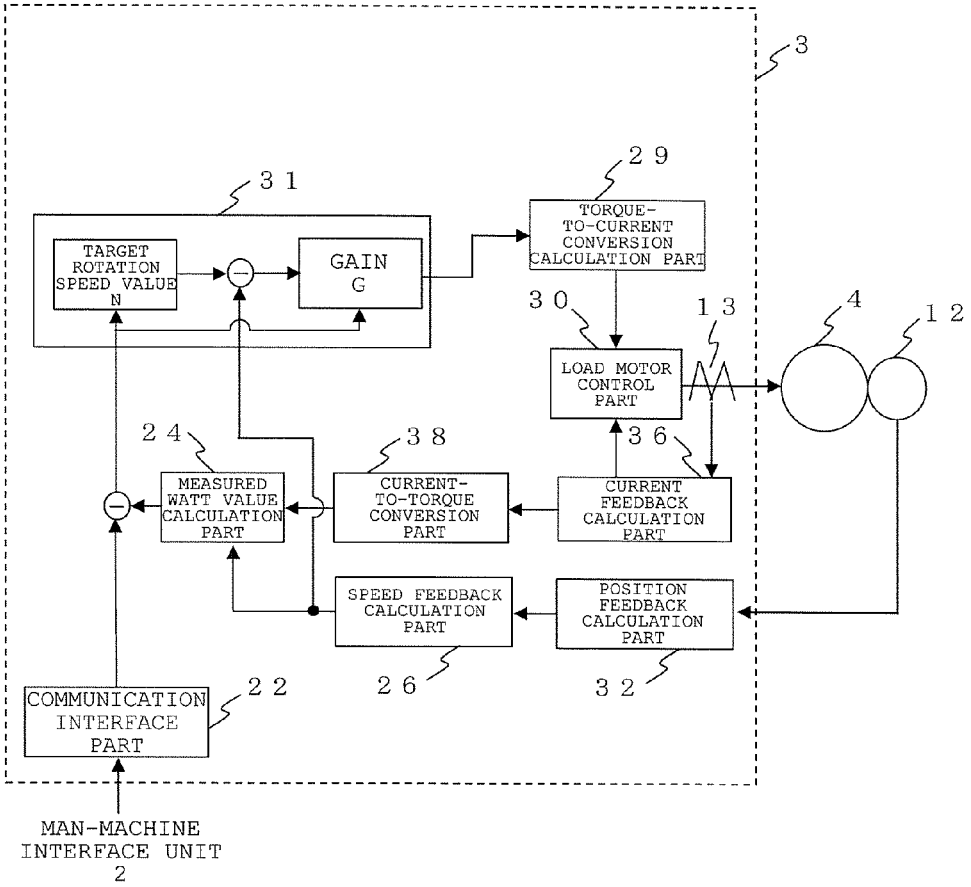
FIG. 8 is a diagram illustrating an example of an internal configuration of a load control unit for performing load torque control on pedals in a related-art exercise therapy device.

$W_{CMD}$: Target watt value (W)
$T_{CMD}$: Target torque value (N·m)
$N_{FB}$: Measured rotation speed value (r/min)
N: Target rotation speed value (r/min)
G: Gain
9.55: Factor of proportionality FIG. 8 is a diagram illustrating an example of an internal configuration of a load control unit 3 for performing load torque control for pedals in a related-art exercise therapy device. In the load control unit 3 illustrated in FIG. 8, the target torque value, which is an output of an isokinetic load control part 31, is adjusted with the target rotation speed value N and the gain G so that the power exerted by the pedaling operation becomes the target watt value output from a man-machine interface unit 2. Note that, functions of respective components of the load control unit 3 are described later.

Figure 9:
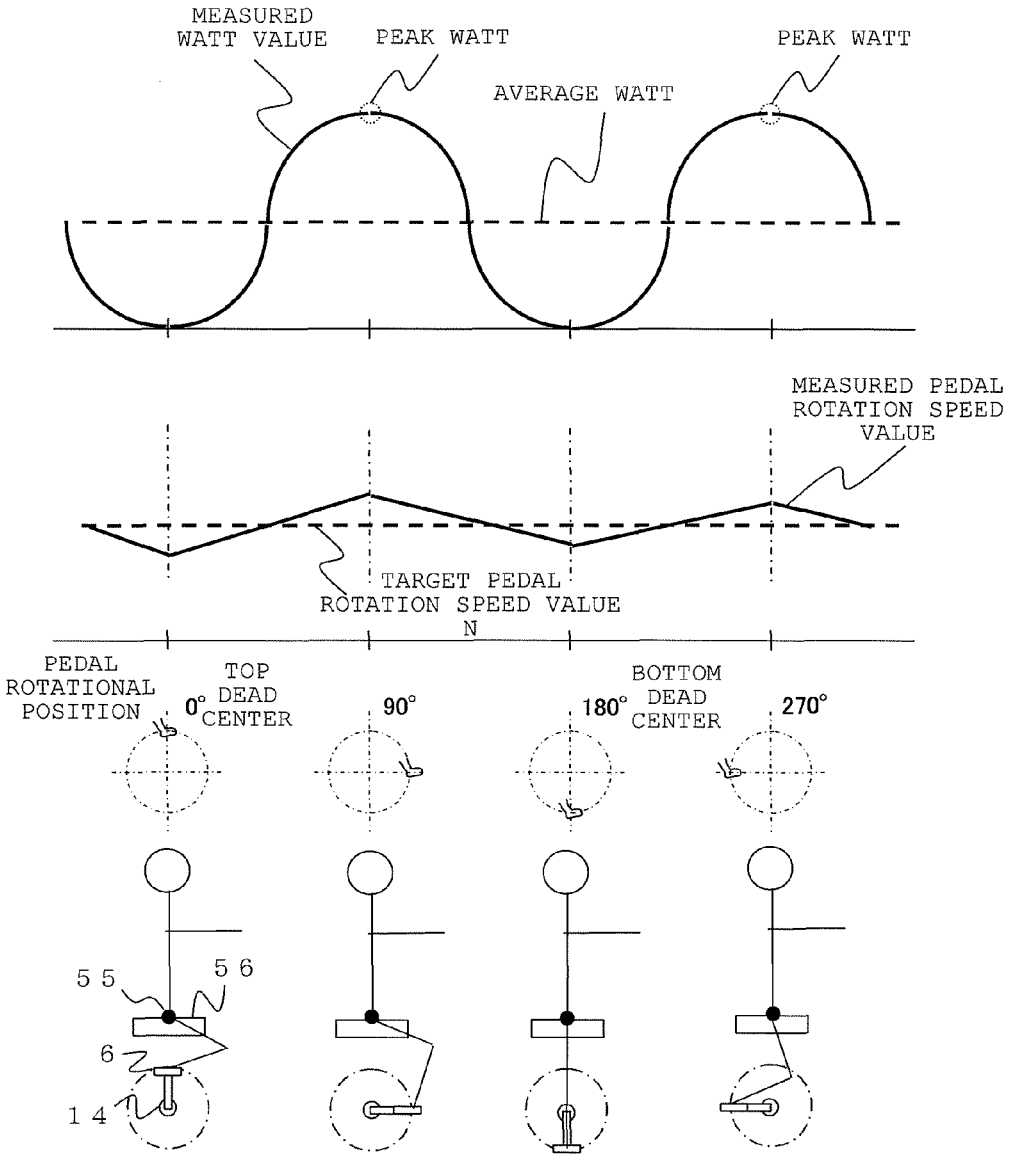
FIG. 9 is a diagram illustrating a relationship between the rotational position of each pedal and a rotation torque applied to each pedal in an exerciser's pedaling operation.

FIG. 9 is a diagram illustrating a relationship between a rotational position of each pedal 6 and a rotation torque applied to each pedal 6 in the exerciser's pedaling operation. As described above, in the constant-watt load control, the target rotation speed value N and the gain G are adjusted so that the power exerted by the exerciser's pedaling operation becomes constant.

Consideration is, however, given of a case where, in the exercise therapy device with which the exerciser operates the pedals 6 to carry out training, control is performed so that the power exerted by a pedaling operation becomes constant at any time even in one rotation of pedaling. In this case, even at the rotational position at which the exerciser has a difficulty in transmitting power to each pedal 6 such as around a top dead center (0°) or bottom dead center) (180° of the pedaling as illustrated in FIG. 9, a similar load torque is applied to each pedal 6. As a result, there is a problem in that, depending on the rotational position of each pedal 6, the exerciser has a difficulty in exerting his/her leg strength.

In view of this, in the load control unit 3 illustrated in FIG. 8, the constant-watt load control is performed at cycles longer than a period of one rotation of pedaling. To be specific, the target torque value applied to the pedal 6 is controlled so that an average watt, which is an average value of the power of one rotation of the exerciser's pedaling, or a peak watt, which is the maximum value of the power, becomes constant among respective rotations of pedaling. In addition, the target rotation speed value N and the gain G are also controlled at the cycles longer than the period of one rotation of pedaling.

As a result, when the target rotation speed value N and the gain G are updated at the cycles longer than the period of one rotation of pedaling, a difference arises between the measured rotation speed value and the target rotation speed value N of each pedal 6, and hence the isokinetic load control functions and the watt to be applied thus becomes more constant and stable as the muscle strength arbitrarily exerted by the exerciser becomes constant. As described above, one advantage of the isokinetic load control is that the load torque applied to the pedal 6 becomes smaller around the top dead center and around the bottom dead center, with the result that the above-mentioned problem is automatically avoided.

Note that, when a relationship between the position of a seating part 56 of the exerciser and the center position of pedal mounting shafts 14 differs from that of FIG. 9, the absolute position of the top dead center (0°) illustrated in FIG. 9 is such a position that a distance from a greater trochanter 55 of the exerciser to a connection portion at which the pedals 6 are connected to the pedal mounting shafts 14 is closest, and other angles change accordingly.

Figure 10:
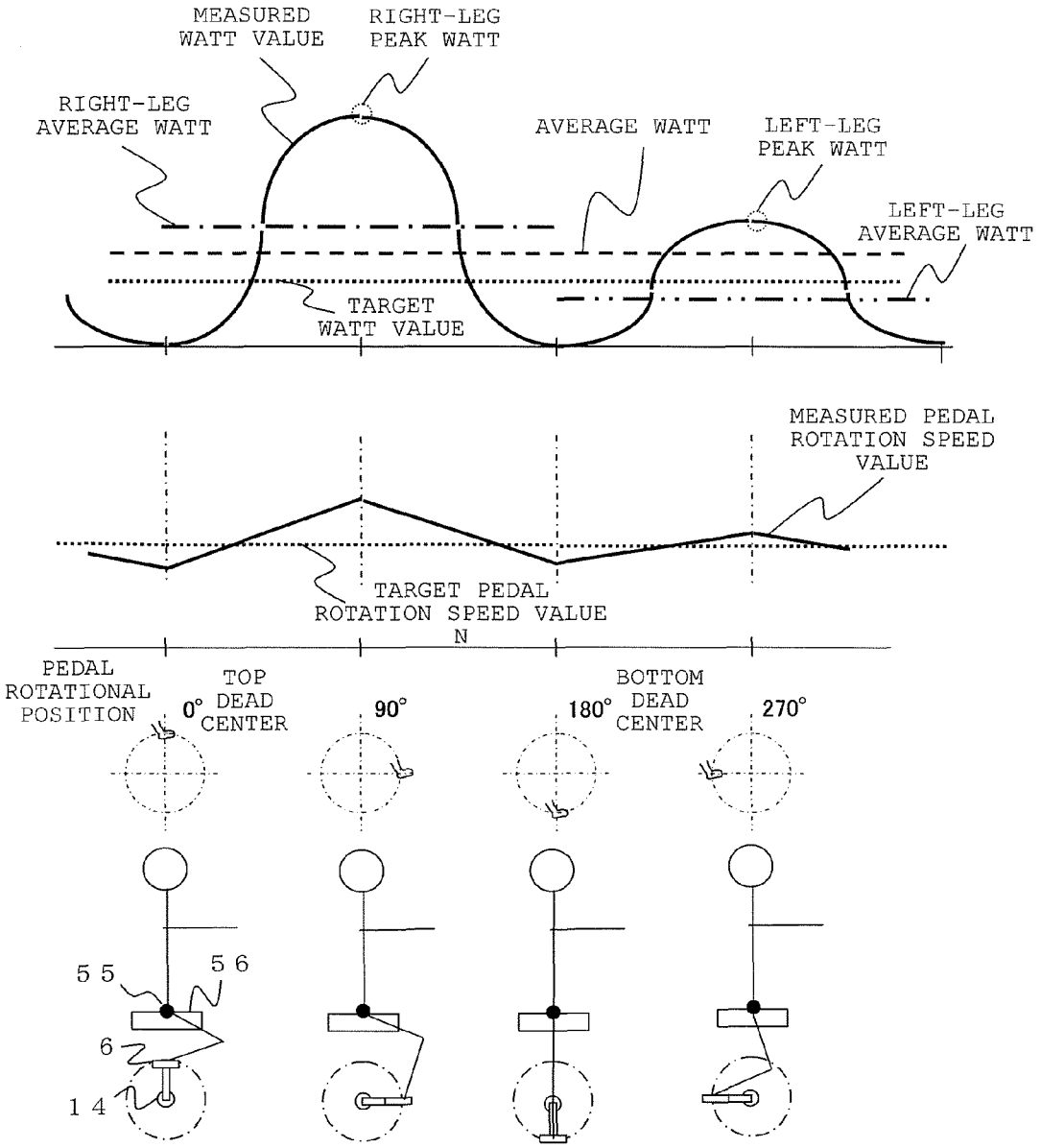
FIG. 10 is a diagram illustrating a relationship between the rotational position of each pedal and a rotation torque applied to each pedal in the exerciser's pedaling operation when the exerciser's leg strength significantly differs between his/her left and right legs.

FIG. 10 is a diagram illustrating a relationship between the rotational position of each pedal 6 and the rotation torque applied to each pedal 6 in the exerciser's pedaling operation when the exerciser's leg strength significantly differs between his/her left and right legs. As illustrated in FIG. 10, when the exerciser's leg strength significantly differs between his/her left and right legs and the muscle strength arbitrarily exerted by the exerciser changes every time, the target torque value and rotation speed of each pedal 6 vary significantly. Therefore, the constant-watt load control using the isokinetic load control lacks accuracy, and as a result, it becomes difficult to perform the constant-watt load control. Note that, FIG. 10 illustrates a case where the leg strength of the right leg is much larger than that of the left leg and the exerciser carries out such pedaling as to step on the right pedal 6 strongly with only his/her right leg.

An average watt obtained when the exerciser's leg strength significantly differs between his/her left and right legs as illustrated in FIG. 10 is a time average of the average watt of the right leg and the average watt of the left leg. Therefore, in the constant-watt load control, the target torque value of each pedal 6 is controlled so that the average watt becomes the target watt value. For example, when the peak watt of the right leg is much larger than the peak watt of the left leg as illustrated in FIG. 10, there is too large a gap between the average watt and each of a right-leg average watt and a left-leg average watt. Therefore, the target torque value of each of the left and right pedals 6 cannot be controlled appropriately any longer with one target rotation speed value N. As described above, in a case of the exerciser whose leg strengths are not balanced between the left and right legs, it has been difficult to perform the constant-watt load control while keeping predominance of the isokinetic load control.

FIG. 1 is a diagram illustrating an example of a configuration of an exercise therapy device 1 according to a first embodiment of the present invention.

The exercise therapy device 1 includes a man-machine interface unit 2 for selecting and setting contents of an exercise and displaying an exercise state and the like, a load control unit 3 for controlling an exercise load to be applied to the exerciser, a load motor 4 controlled by the load control unit 3 to generate the exercise load, a speed reduction mechanism 5 for transmitting the exercise load generated by the load motor 4 to the legs of the exerciser as an appropriate load torque and rotation speed, pedal mounting shafts 14 mounted and coupled to the speed reduction mechanism 5 so as be freely rotatable, and pedals 6 coupled to the pedal mounting shafts 14 so as be freely rotatable and used by the exerciser to carry out an exercise by actually placing his/her legs thereon.

Note that, the right-foot and left-foot pedal mounting shafts 14 and the right-foot and left-foot pedals 6 are arranged so as to face opposite directions and be perpendicular to a rotation axis of the pedal mounting shafts 14 so that the exercise loads are applied to both legs of the exerciser.

Next, the man-machine interface unit 2 illustrated in FIG. 1 includes a control part 7, a display device 8, a storage part 9, an input device 10, and a communication interface 11.

The control part 7 controls the load control unit 3 via the communication interface 11 in accordance with set values of the exercise load and exercise time period (or the number of pedal rotations) for training (hereinafter referred to as "exercise program"), which are stored in the storage part 9. Further, the control part 7 inputs the exercise program from the input device 10 and stores the input exercise program in the storage part 9. Further, the control part 7 graphically displays the exercise program of the storage part 9 on the display device 8, and displays information on the rotational position and rotation speed of each pedal 6, which is input from the load control unit 3 to be described later, on the display device 8.

The load control unit 3 illustrated in FIG. 1 controls the load motor 4 in accordance with a target exercise load value output from the man-machine interface unit 2. Further, the load control unit 3 calculates the rotational position and rotation speed of the pedal 6 based on measured values of the rotational position and rotation speed of a rotation shaft of the load motor 4, which are output from a position/speed detector 12 mounted to the load motor 4, and outputs the calculated rotational position and rotation speed to the man-machine interface unit 2.

Figure 2:
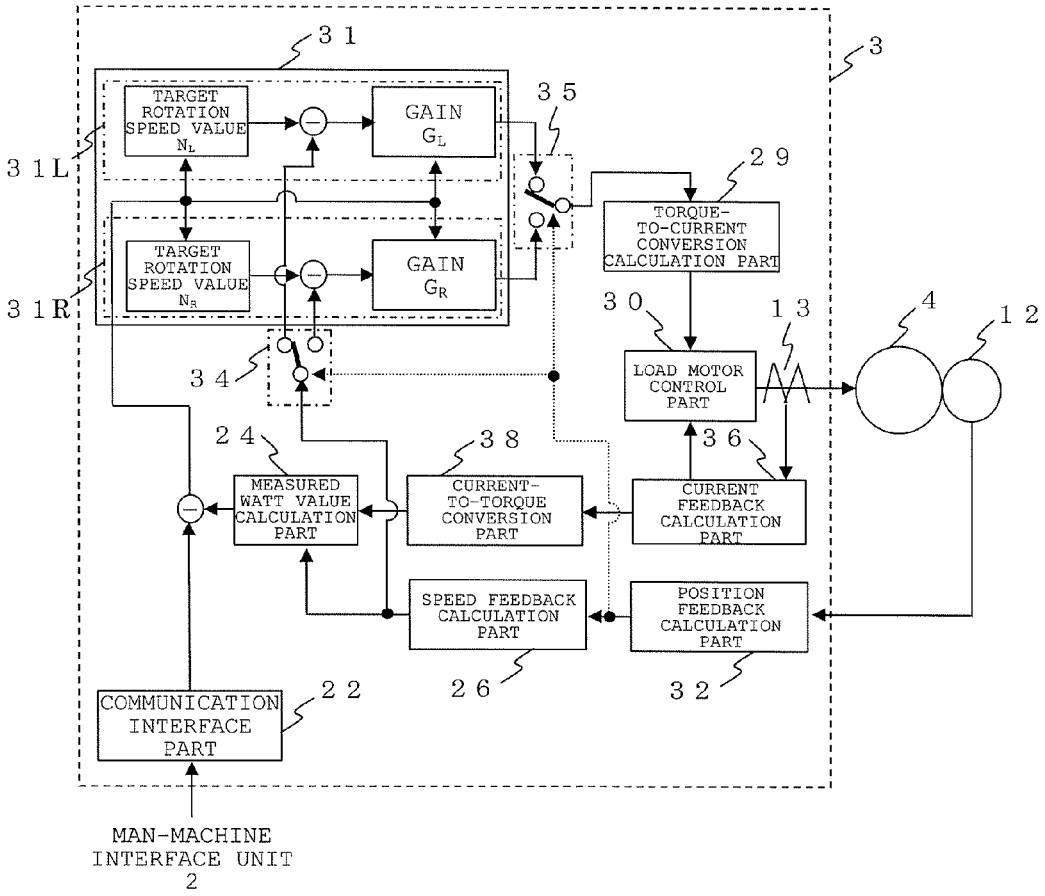
FIG. 2 is a diagram illustrating an example of an internal configuration of a load control unit of the exercise therapy device illustrated in FIG. 1.

FIG. 2 is a diagram illustrating an example of an internal configuration of the load control unit 3 illustrated in FIG. 1. A current feedback calculation part 36 converts a current value output from a current detector 13 mounted to the load motor 4 into a current value of the load motor 4 and outputs the resultant as a measured current value. A current-to-torque conversion part 38 converts the measured current value into a measured torque value and outputs the resultant. A measured watt value calculation part 24 multiplies the measured torque value by a measured rotation speed value output from a speed feedback calculation part 26 and outputs the resultant as a measured watt value.

A communication interface part 22 receives the target watt value as the target exercise load value set by the man-machine interface unit 2 and outputs the received target watt value. An isokinetic load control part 31 inputs a watt difference, which is a difference between the target watt value and the measured watt value, and the measured rotation speed value of the pedal 6 output from the speed feedback calculation part 26, and performs the isokinetic load control on the load torque of each pedal 6 in accordance with Expression (2) given above.

To be specific, the isokinetic load control part 31 compares the measured watt value with the target watt value, and when the measured watt value is larger than the target watt value, increases target rotation speed values $N_L$ and $N_R$ of the respective pedals 6. As a result, the difference between the measured rotation speed value and each of the target rotation speed values $N_L$ and $N_R$ of Expression (2) given above becomes smaller, and hence the target torque value becomes smaller. On the other hand, when the measured watt value is equal to or less than the target watt value, the isokinetic load control part 31 decreases the target rotation speed values $N_L$ and $N_R$ of the respective pedals 6. As a result, the difference between the measured rotation speed value and each of the target rotation speed values $N_L$ and $N_R$ of Expression (2) given above becomes larger, and hence the target torque value becomes larger.

A torque-to-current conversion calculation part 29 converts the target torque value output from the isokinetic load control part 31 into a target current value and outputs the resultant. A load motor control part 30 performs feedback control on the load motor 4 so that the measured current value output from the current feedback calculation part 36 becomes the target current value. The load control unit 3 repeats the above-mentioned control until the training is finished.

Consideration is next given of the case where the strength of the exerciser's leg significantly differs between his/her left and right legs. In the following description, assumed is a case where the exerciser's right leg strength is larger than his/her left leg strength, and such an exercise that the pedals 6 rotate at a high speed when the exerciser strongly operates the right pedal with his/her right leg and the pedals 6 rotate at a low speed when the exerciser weakly operates the left pedal with his/her left leg continues. This case is a state that is often observed when an exerciser whose leg strength significantly differs between his/her left and right legs, such as a patient with hemiplegia, carries out an exercise. Under this state, the rotation speeds of the left leg and the right leg differ between the left and right pedals, but the left leg and the right leg have a substantially constant rotation speed each.

Figure 3:
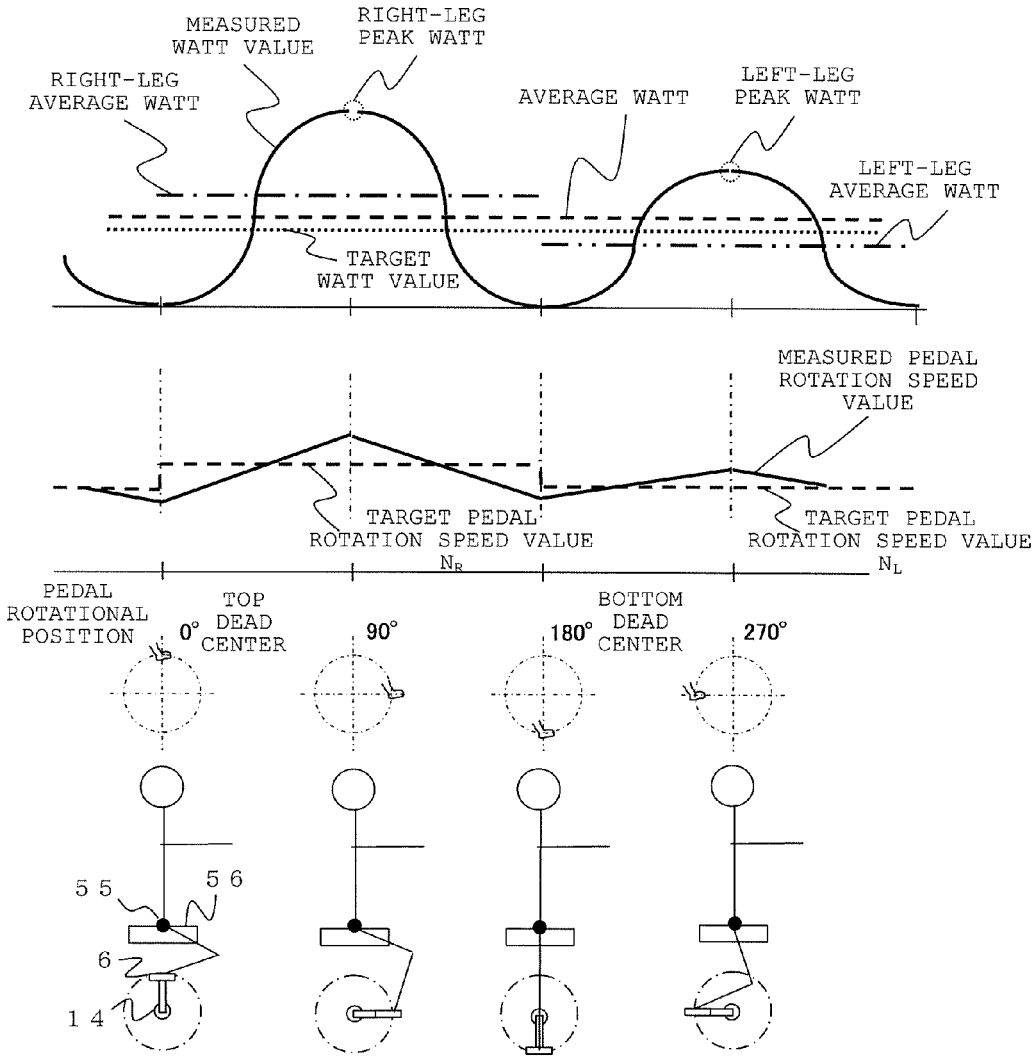
FIG. 3 is a diagram illustrating a relationship between a rotational position of each pedal and a rotation torque applied to each pedal in an exerciser's pedaling operation when the exerciser's leg strength significantly differs between his/her left and right legs according to the first embodiment of the present invention.

FIG. 3 is a diagram illustrating a relationship between the rotation torque exerted by the pedaling operation and the rotational position of each pedal 6 when the exerciser's leg strength significantly differs between his/her left and right legs according to the first embodiment of the present invention.

The isokinetic load control part 31 performs the isokinetic load control independently on the load torques of the left and right pedals 6. A speed switch 34 switches an isokinetic load control part to be used between left and right isokinetic load control parts 31L and 31R in accordance with the rotational position of each pedal 6, which is determined based on a measured rotational position value output from a position feedback calculation part 32. At this time, the measured rotation speed value output from the speed feedback calculation part 26 is output to the selected one of the isokinetic load control parts 31L and 31R. As a result, while using the measured rotation speed value in common between the left and right isokinetic load control parts, it is possible to hold and adjust the target rotation speed values $N_L$ and $N_R$ and gains $G_L$ and $G_R$ as values optimized for the left leg and the right leg, respectively, and switch the target torque value with a torque switch 35, and hence stable isokinetic load control is performed.

In this manner, it is possible to determine one of the pedals 6 operated by one of the legs with which the exerciser's pedaling is mainly carried out based on the rotational position of each pedal 6 to switch the isokinetic load control part to be used between the isokinetic load control parts 31L and 31R. With this, it is possible to hold and adjust the values optimized for the left leg and the right leg, respectively, as the target rotation speed values $N_L$ and $N_R$ and the gains $G_L$ and $G_R$. As a result, even when the rotation speeds of the pedals 6 differ between the left and right pedals, it is possible to acquire the target torque values for realizing the target watt values individually for the left and right pedals.

Figure 4:
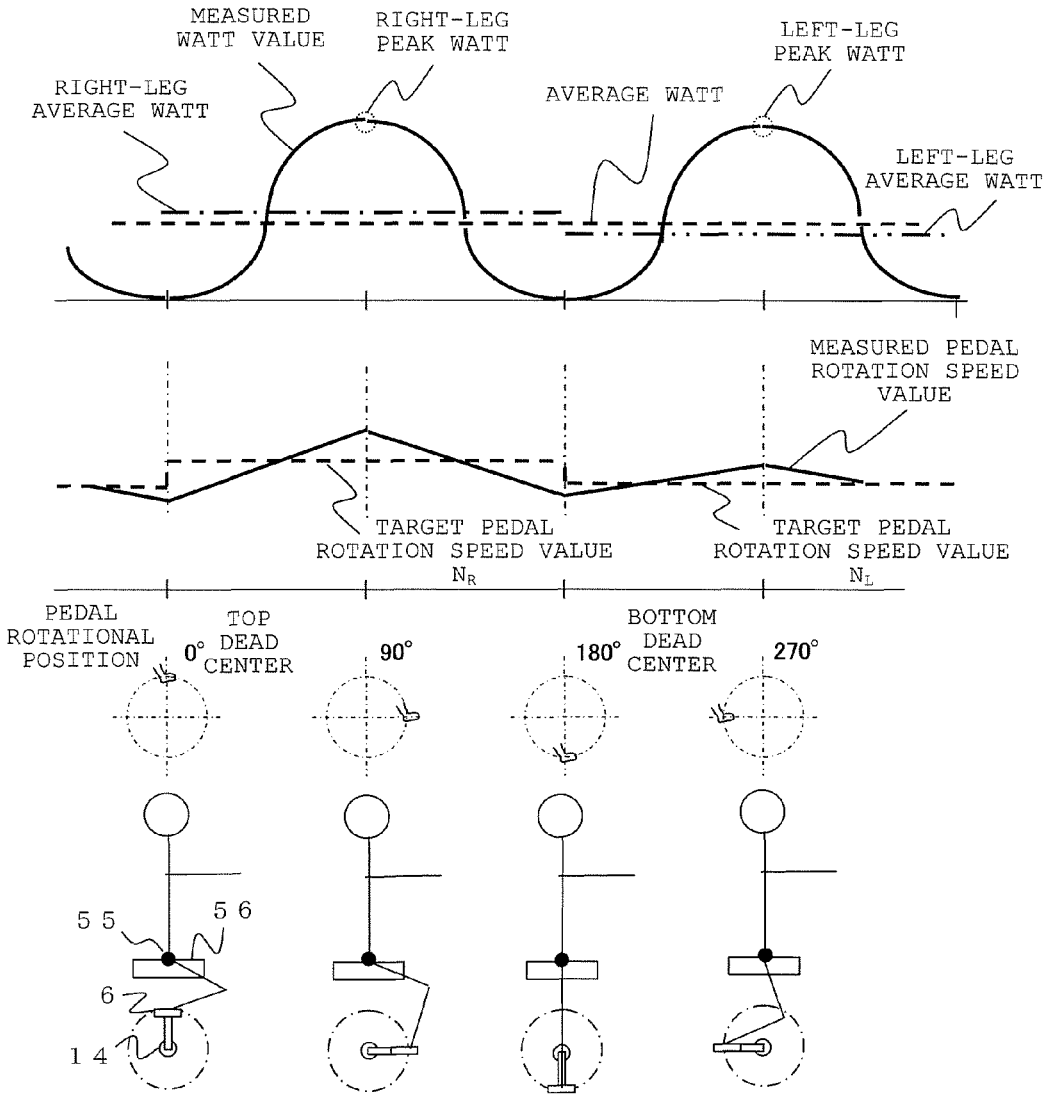
FIG. 4 is a diagram illustrating a measured watt value obtained when isokinetic load control is performed so that a left-leg peak watt matches a right-leg peak watt in FIG. 3.

FIG. 4 is a diagram illustrating the measured watt value obtained when the isokinetic load control is performed so that the left-leg peak watt matches the right-leg peak watt in FIG. 3. The following two methods are conceivable as a method of controlling the target rotation speed values $N_L$ and $N_R$ and the gains $G_L$ and $G_R$ in order that the average watt, which is an average value of the right-leg average watt and the left-leg average watt that are obtained when one rotation of pedaling is considered as divided right-leg rotation and left-leg rotation, matches the target watt value, and any of those methods are applicable. A first method is a method of controlling the target rotation speed values $N_L$ and $N_R$ and the gains $G_L$ and $G_R$ so that, although the left-leg peak watt and the right-leg peak watt differ from each other, the average watt of one rotation of pedaling matches the target watt value as illustrated in FIG. 3. Further, a second method is a method of controlling the target rotation speed values $N_L$ and $N_R$ and the gains $G_L$ and $G_R$ so that the left-leg peak watt matches the right-leg peak watt as well, as illustrated in FIG. 4.

As described above, in the first embodiment, the control apparatus for an exercise therapy device, with which the exerciser operates the pedals to carry out the training, the control apparatus being configured to use the isokinetic load control and the constant-watt load control in combination, has the following technical features. Specifically, the target rotation speed value and the gain for the left pedal and the target rotation speed value and the gain for the right pedal are adjusted independently to perform the isokinetic load control on the load torque to be applied to the left pedal and the load torque to be applied to the right pedal independently. In addition, which of the isokinetic load control for the left pedal and the isokinetic load control for the right pedal is to be used is determined and switched based on the information on the rotation torque applied to each pedal by the exerciser's pedaling or the information on the rotational position of each pedal. As a result, even when the strength of the exerciser's leg significantly differs between his/her left and right legs, it is possible to control the exercise load while using the isokinetic load control and the constant-watt load control in combination.

Further, even when the muscle strengths exerted by the exerciser differ between his/her left and right legs, under the condition that the exerciser carries out a stable exercise with each of the left and right legs, the watt to be applied becomes more constant and accurate even with the exercise therapy device using the isokinetic load control part. As a result, an exercise prescription prescribed by a doctor or other such person can be carried out accurately.

Further, the use of the pedal rotational position is adopted as a method of determining a leg with which the exerciser mainly carries out the exercise enhances accuracy of determining a leg with which the exerciser mainly carries out the exercise.

Note that, in the method of changing the target rotation speed values $N_L$ and $N_R$ and the gains $G_L$ and $G_R$ based on the difference between the target watt value and the measured watt value, both of the sets of the target rotation speed values $N_L$ and $N_R$ and the gains $G_L$ and $G_R$ may be set as variables, or one of those sets of values may be set in advance as fixed values and only one of those may be set as variables.

Second Embodiment

Figure 5:
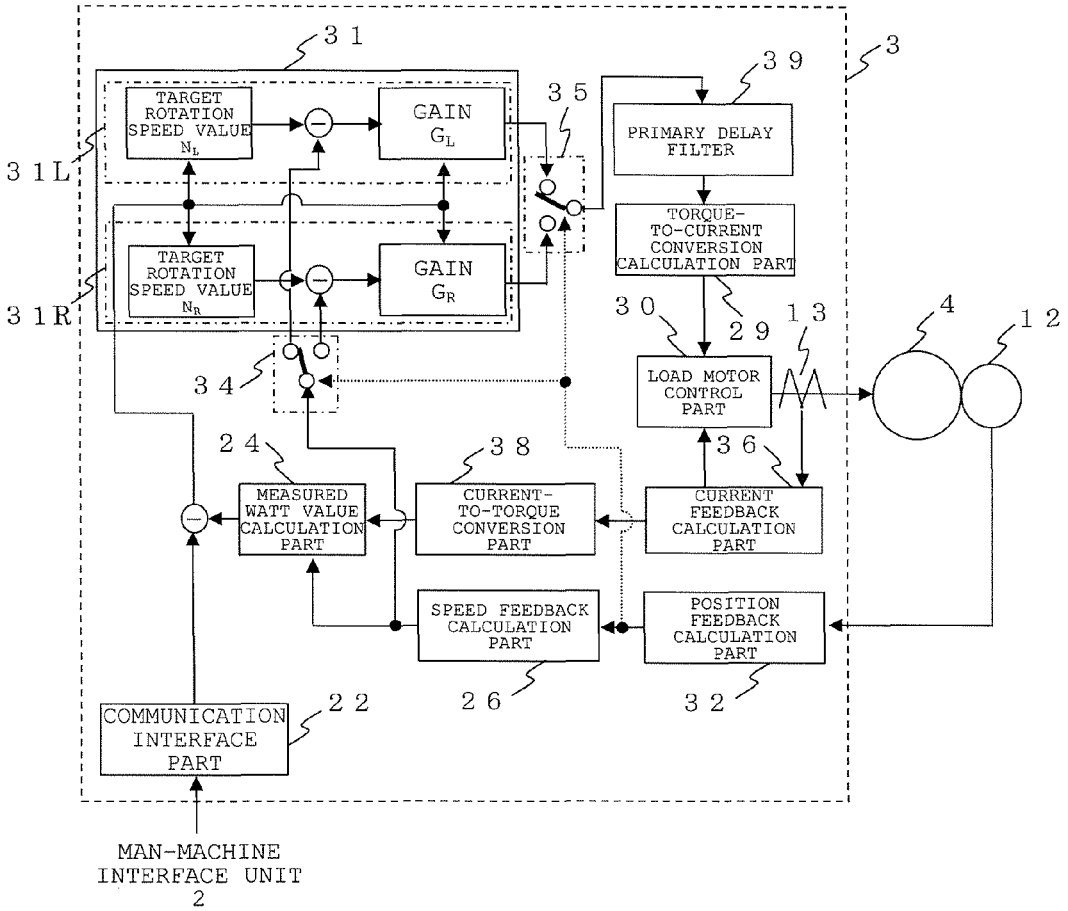
FIG. 5 is a diagram illustrating an example of a configuration in which a primary delay filter for smoothing a target torque value is provided to a control apparatus for an exercise therapy device according to a second embodiment of the present invention.

FIG. 5 is a diagram illustrating an example of a configuration in which a primary delay filter 39 for smoothing the target torque value is provided to a control apparatus for the exercise therapy device 1 according to a second embodiment of the present invention.

In FIG. 5, the primary delay filter 39 for smoothing discontinuity of the target torque value is provided at a subsequent stage of the torque switch 35. When the isokinetic load control is performed independently on the load torques to be applied to the left and right pedals 6, the rotation speed of each of the left and right pedals 6 is not always constant. In a case where the rotation speed of each of the left and right pedals 6 changes to some degree and at the time of switching the target torque value, and in a case where the target rotation speed values $N_L$ and $N_R$ and the gains $G_L$ and $G_R$ are adjusted, the target torque value of each of the isokinetic load control parts 31L and 31R changes abruptly. In view of this, the primary delay filter 39 is provided to add a filter function for preventing an abrupt change of the torque from occurring in those cases.

Figure 6:
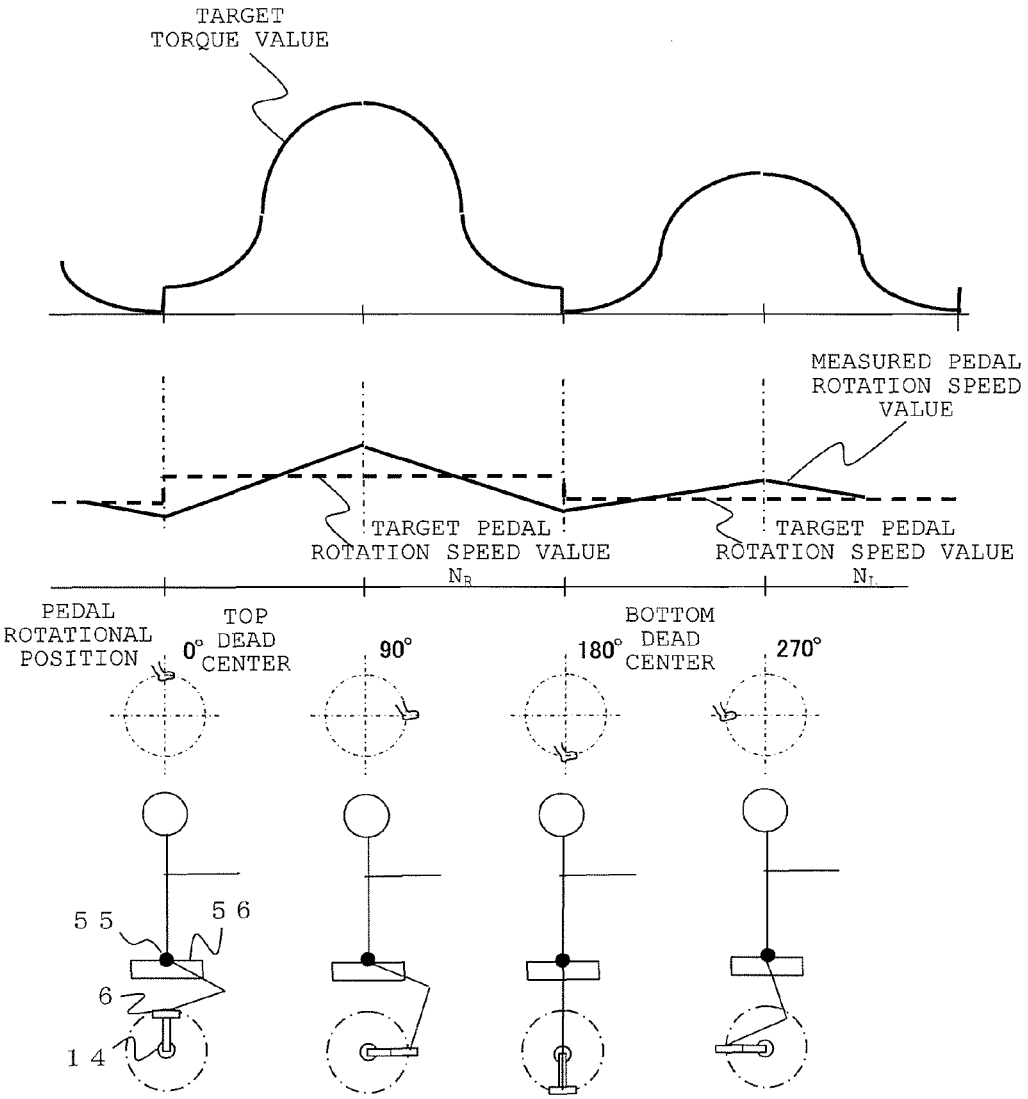
FIG. 6 is a diagram illustrating the target torque value obtained when a primary delay filter is not provided according to the second embodiment of the present invention.
Figure 7:
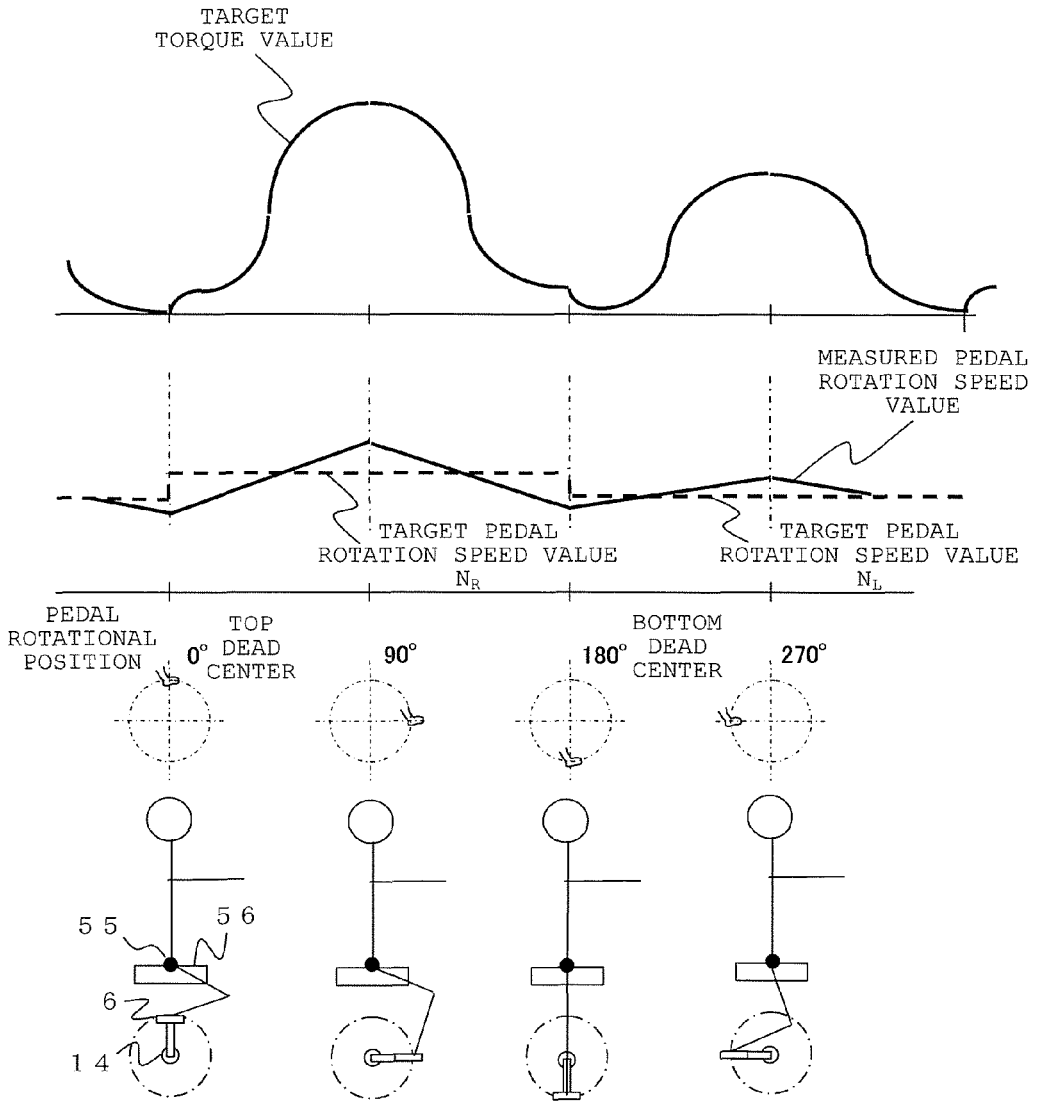
FIG. 7 is a diagram illustrating the target torque value obtained when the primary delay filter is provided according to the second embodiment of the present invention.

FIG. 6 is a diagram illustrating the target torque value obtained when the primary delay filter 39 is not provided according to the second embodiment of the present invention. Further, FIG. 7 is a diagram illustrating the target torque value obtained when the primary delay filter 39 is provided according to the second embodiment of the present invention.

In FIG. 6, an abrupt change of the load torque occurs when the rotational position of each of the pedals 6 is at around 0° and 180°. In contrast, in FIG. 7, an abrupt change of the target torque value is suppressed at around the above-mentioned degrees by virtue of an effect of the primary delay filter 39.

As described above, in the second embodiment, the primary delay filter 39 for smoothing an abrupt change of the torque, which occurs when the target torque value is switched between the left and right isokinetic load control parts under the state in which the load torque values output from the left and right isokinetic load control parts differ from each other, is provided. As a result, even under the state in which the difference between the target torque values output from the left and right isokinetic load control parts is large, an abrupt change of the target torque value is suppressed by the primary delay filter 39, and hence the pedals become more comfortable to operate.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. An exercise therapy device, which is configured to use isokinetic load control and constant-watt load control in combination when an exerciser operates right and left pedals to carry out training, the isokinetic load control controlling a load torque to be applied to each of the right and left pedals so that the load torque becomes equal to a rotation torque applied to each of the right and left pedals by pedaling of the exerciser, the constant-watt load control controlling a target torque value to be applied to each of the right and left pedals so that one of an average watt, which is an average value of a power in one rotation of the pedaling of the exerciser, and a peak watt, which is a maximum value of the power, becomes constant among rotations of the pedaling, the exercise therapy device comprising:

a man-machine interface unit, used by the exerciser, configured for selecting and setting a target exercise load value;

a load control unit configured for controlling an exercise load to be applied to the exerciser according to the target exercise load value;

one load motor controlled by the load control unit to generate the exercise load;

a speed reduction mechanism configured for transmitting the exercise load generated by the one load motor to legs of the exerciser as a load torque and rotation speed; and the right pedal and the left pedal are coupled to the speed reduction mechanism so as to be freely rotatable when used by the exerciser, wherein the load control unit comprises:

an isokinetic load control part configured for holding and adjusting a target rotation speed value and a gain for the left pedal and a target rotation speed value and a gain for the right pedal independently, to thereby perform the constant-watt load control among the rotations of the pedaling while performing the isokinetic load control to control the load torque to be applied to the left pedal and the load torque to be applied to the right pedal independently; and a switch configured for determining, based on one of information on the rotation torque applied to each of the right and left pedals by the pedaling of the exerciser and information on a rotational position of each of the right and left pedals, which of the isokinetic load control for the left pedal and the isokinetic load control for the right pedal is to be used, to thereby switch a measured rotation speed value, which is a value input to the isokinetic load control, between an input for the isokinetic load control for the left pedal and an input for the isokinetic load control for the right pedal and to switch the target torque value, which is a value output from the isokinetic load control, between an output of the isokinetic load control for the left pedal and an output of the isokinetic load control for the right pedal, wherein the exercise therapy device controls the exercise load by using the isokinetic load control and the constant-watt load control in combination by the use of only the one load motor.

2. The exercise therapy device according to claim 1, wherein the switch determines which of the isokinetic load control for the left pedal and the isokinetic load control for the right pedal is to be used based on the rotational position of each of the right and left pedals.

3. The exercise therapy device according to claim 1, wherein the isokinetic load control part further comprises a primary delay filter configured for smoothing an abrupt change of the load torque to be applied to each of the right and left pedals.

4. The exercise therapy device according to claim 2, wherein the isokinetic load control part further comprises a primary delay filter configured for smoothing an abrupt change of the load torque to be applied to each of the right and left pedals.

5. A control method for an exercise therapy device executed using the load control unit of the exercise therapy device of claim 1, the control method comprising:

holding and adjusting a target rotation speed value and a gain for the left pedal and a target rotation speed value and a gain for the right pedal independently, to thereby perform the constant-watt load control among the rotations of the pedaling while performing the isokinetic load control to control the load torque to be applied to the left pedal and the load torque to be applied to the right pedal independently; and determining, based on one of information on the rotation torque applied to each of the right and left pedals by the pedaling of the exerciser and information on a rotational position of each of the right and left pedals, which of the isokinetic load control for the left pedal and the isokinetic load control for the right pedal is to be used, to thereby switch a measured rotation speed value, which is a value input to the isokinetic load control, between an input for the isokinetic load control for the left pedal and an input for the isokinetic load control for the right pedal and to switch the target torque value, which is a value output from the isokinetic load control, between an output of the isokinetic load control for the left pedal and an output of the isokinetic load control for the right pedal, wherein the control method controls the exercise load by using the isokinetic load control and the constant-watt load control in combination by the use of only the one load motor.

* * * * *